US010989055B2

(12) United States Patent
Wichers et al.

(10) Patent No.: US 10,989,055 B2
(45) Date of Patent: Apr. 27, 2021

(54) COOLING FAN MODULE

(71) Applicant: BROSE FAHRZEUGTEILE GMBH & CO. KOMMANDITGESELLSCHAFT, WUERZBURG, Wuerzburg (DE)

(72) Inventors: Marco Wichers, Bad Zwischenahn (DE); Joern Smidt, Ditzum (DE); Peter Arnold, Osnabrueck (DE)

(73) Assignee: BROSE FAHRZEUGTEILE GMBH & CO. KOMMANDITGESELLSCHAFT, WUERZBURG, Wuerzburg (DE)

( * ) Notice: Subject to any disclaimer, the term of this patent is extended or adjusted under 35 U.S.C. 154(b) by 112 days.

(21) Appl. No.: 16/190,414

(22) Filed: Nov. 14, 2018

(65) Prior Publication Data

US 2019/0353083 A1 Nov. 21, 2019

(30) Foreign Application Priority Data

Nov. 15, 2017 (DE) ..... 102017126823.5

(51) Int. Cl.

| | |
|---|---|
| ***F01D 5/14*** | (2006.01) |
| ***F01P 5/04*** | (2006.01) |
| ***F04D 29/18*** | (2006.01) |
| ***F04D 29/24*** | (2006.01) |
| *F01P 5/06* | (2006.01) |

(Continued)

(52) U.S. Cl.

CPC ..... *F01D 5/141* (2013.01); *F01P 5/04* (2013.01); *F04D 29/181* (2013.01); *F04D 29/245* (2013.01); *F01P 5/06* (2013.01); *F01P 11/10* (2013.01); *F01P 2005/046* (2013.01);

(Continued)

(58) Field of Classification Search

CPC ..... F05D 2260/961

See application file for complete search history.

(56) References Cited

U.S. PATENT DOCUMENTS 5,582,507 A * 12/1996 Alizadeh ..... F04D 19/002 248/604

5,961,289 A 10/1999 Lohmann (Continued)

FOREIGN PATENT DOCUMENTS

CN 203926066 U 11/2014

DE 4020952 A1 1/1992

(Continued)

OTHER PUBLICATIONS

Distelkamp, DE 19638518, machine translation. (Year: 1998).*

*Primary Examiner* — Hung Q Nguyen

*Assistant Examiner* — Mark L. Greene

(74) *Attorney, Agent, or Firm* — Brooks Kushman, P.C.

(57) ABSTRACT

It is provided a cooling fan module having: a fan shroud; a fan propeller cutout, which is formed in the fan shroud; a motor mount which is mechanically connected to the fan shroud by means of struts which are located at the rear viewed in the flow direction; a motor, which is mounted at least partially in the motor mount; a fan propeller which is arranged in the fan propeller cutout and which is driven rotationally about a rotational axis R by the motor. The fan propeller has a plurality of blade elements. All the elements of a group which has at least one of the struts and at least one of the blade elements are forward-sickled or rearward-sickled.

19 Claims, 8 Drawing Sheets

(51) Int. Cl.

| | |
|---|---|
| *F01P 11/10* | (2006.01) |
| *F04D 29/00* | (2006.01) |
| *F04D 29/26* | (2006.01) |
| *F04D 29/64* | (2006.01) |

(52) U.S. Cl.
CPC ..... *F01P 2070/50* (2013.01); *F04D 29/002* (2013.01); *F04D 29/263* (2013.01); *F04D 29/644* (2013.01)

(56) References Cited

U.S. PATENT DOCUMENTS

| | | | | | |
|---|---|---|---|---|---|
| RE39,774 | E * | 8/2007 | Chang | F01D 25/24 | 415/193 |
| 9,822,800 | B2 | 11/2017 | Pegues et al. | | |
| 2003/0012656 | A1* | 1/2003 | Cho | F04D 29/326 | 416/235 |
| 2005/0271529 | A1 | 12/2005 | Stommel et al. | | |
| 2007/0140844 | A1* | 6/2007 | Yoshida | F04D 29/544 | 415/220 |
| 2008/0308261 | A1* | 12/2008 | Aschermann | F04D 29/542 | 165/121 |
| 2012/0020802 | A1* | 1/2012 | Schreiber | F01D 5/286 | 416/224 |
| 2012/0321474 | A1* | 12/2012 | Stevens | F01P 5/06 | 416/190 |
| 2013/0153181 | A1* | 6/2013 | Speretta | F01P 5/06 | 165/121 |
| 2015/0176605 | A1* | 6/2015 | Pegues | B60K 11/02 | 415/208.1 |
| 2015/0252812 | A1* | 9/2015 | Sauer | F04D 25/08 | 417/423.14 |

FOREIGN PATENT DOCUMENTS

| | | | | |
|---|---|---|---|---|
| DE | 4222264 | A1 | 1/1994 | |
| DE | 19638518 | A1 * | 4/1998 | F04D 29/661 |
| DE | 69529379 | T2 | 10/2003 | |
| DE | 102006062118 | A1 | 6/2007 | |
| DE | 102010032097 | A | 1/2012 | |
| DE | 102012112211 | A1 | 9/2013 | |
| DE | 102016203327 | A1 | 9/2017 | |
| EP | 2336569 | A1 | 6/2011 | |
| GB | 2344619 | A | 6/2000 | |
| JP | 2007192217 | A | 8/2007 | |
| JP | 2015108317 | A | 6/2015 | |
| KR | 100761152 | B1 | 9/2007 | |
| WO | 2005003569 | A1 | 1/2005 | |
| WO | 2013160432 | A1 | 10/2013 | |
| WO | 2014056655 | A2 | 4/2014 | |
| WO | 2017137115 | A1 | 8/2017 | |

* cited by examiner

Cooling fan module with struts according to an embodiment of the present invention

COOLING FAN MODULE

CROSS-REFERENCE TO RELATED APPLICATIONS

This application claims priority to German Patent Application No. 10 2017 126 823.5 filed on Nov. 15, 2017, the entirety of which is incorporated by reference herein.

TECHNICAL FIELD

The present disclosure relates to a cooling fan module, in particular to an electrically operated cooling fan module, in particular for motor vehicles.

BACKGROUND

A cooling system for an internal combustion engine, in particular of a motor vehicle, carries away heat generated from the walls of the combustion chamber and cylinder. Because excessively high temperatures may damage the engine (e.g., deterioration of lubrication film, burning of the valves), the internal combustion engine must be actively cooled.

Modern internal combustion engines, in particular four-stroke engines in motor vehicles, are, with a few exceptions, liquid-cooled, wherein as a rule a mixture of water, anti-freeze and anticorrosive fluids are used as the cooling fluid.

The cooling fluid is pumped via hoses, pipes and/or ducts through the engine (cylinder head and engine block) as well as, if appropriate, through thermally highly stressed parts which are attached to the engine, such as exhaust gas turbochargers, generators or exhaust gas recirculation coolers. In this context, the cooling fluid absorbs thermal energy and carries it away from the abovementioned components. The heated cooling fluid flows on to a cooler. This cooler—previously often made of brass, nowadays usually made of aluminum—is usually mounted at the front of the motor vehicle, where an air flow absorbs thermal energy from the coolant and therefore cools the latter before it flows back again to the engine, as a result of which the coolant circuit is closed.

In order to drive the air through the cooler, a cooling fan module which can be driven mechanically by means of a belt drive or electrically by means of an electric motor is provided upstream or downstream of the cooler viewed in the (main) flow direction. The following statements relate to an electrically driven cooling fan module.

SUMMARY

Against this background, the present disclosure describes an improved cooling fan module which is advantageous, in particular, with respect to the generation of noise.

According to one or more embodiments, a cooling fan module is provided. The cooling fan module has a fan shroud, a fan propeller cutout, which is formed in the fan shroud, a motor mount which is mechanically connected to the fan shroud by means of struts which are located at the rear viewed in the flow direction, a motor, in particular an electric motor, which is mounted at least partially in the motor mount, and a fan propeller which is arranged in the fan propeller cutout and which is driven rotationally about a rotational axis by the motor, wherein the fan propeller has a plurality of blade elements, wherein at least all the elements of a group which has at least one of the struts and at least one of the blade elements are forward-sickled or rearward-sickled.

A "cooling fan module" according to one or more embodiments of this disclosure, may be an assembly which is arranged upstream or downstream of a cooler of a vehicle viewed in the flow direction and which is provided, in particular configured, to generate an air volume flow which extends through the cooler and/or around the cooler, wherein the air volume flow absorbs thermal energy from the cooler.

A "fan shroud" according to one or more embodiments of this disclosure, may be a frame in which the fan propeller is mounted and is itself in turn preferably arranged, in particular secured, on or in the vicinity of the cooler. A fan shroud according to the present disclosure preferably has a plastic material, in particular a plastic compound, in particular the fan shroud is formed therefrom. Additionally and/or alternatively, the fan shroud has a metal material, for example iron, steel, aluminum, magnesium or the like, in particular it is formed at least partially, in particular at least essentially, in particular completely, therefrom. According to one embodiment, a fan shroud can also have more than one fan propeller cutout, one motor mount, one motor and one fan propeller is suitable for use in cooling fan modules with two or more, in particular two, fan propellers. According to one embodiment, the fan shroud additionally has at least one closable opening, in particular at least one flap, in particular a plurality thereof. This is advantageous, in particular, since in this way further air guiding properties can be implemented.

According to one embodiment of the present disclosure, the group comprises a plurality, in particular all, of the struts and/or a plurality, in particular all, of the blade elements.

This is advantageous, in particular, since in this way the effect described above is amplified. The more struts or blade elements are matched to one another as described, the more advantageous are the properties of the cooling fan module with respect to the generation of noise.

According to a further embodiment of the present disclosure, a blade element mean line of the blade elements of the group and a strut mean line of the struts of the group in a profile section are related to one another by means of:

$$X\text{-coordinate} = f(\alpha_S(n), \alpha_R, D_H, L_P, n, \beta_S(n), \beta_R(n)) = \sin\left(\alpha_{S(n)} \cdot \left(\frac{D_H}{2} + \frac{L_P \cdot n}{n_{max}}\right)\right) + \beta_S(n) + \cos\left(\alpha_S(n) + \frac{\alpha_R}{2}\right) \cdot \frac{L_P \cdot n}{n_{max}} \cdot \sqrt{2} \cdot \sqrt{1 - \cos(\alpha_R)} + \beta_R(n)$$

$$Y\text{-coordinate} = f(\alpha_S(n), \alpha_R, D_H, L_P, n, \beta_S(n), \beta_R(n)) = \cos\left(\alpha_{S(n)} \cdot \left(\frac{D_H}{2} + \frac{L_P \cdot n}{n_{max}}\right)\right) + \beta_S(n) + \cos\left(\alpha_S(n) + \frac{\alpha_R}{2}\right) \cdot \frac{L_P \cdot n}{n_{max}} \cdot \sqrt{2} \cdot \sqrt{1 - \cos(\alpha_R)} + \beta_R(n)$$

where the following applies:

X coordinate describes the X coordinate of the point of intersection of the strut mean line with a sectional plane in an x-y coordinate system in the sectional plane Y coordinate describes the Y coordinate of the point of intersection of the strut mean line with a sectional plane in an x-y coordinate system in the sectional plane n describes a profile section which is currently under consideration $n_{max}$ describes into how many equidistant profile sections the strut and the blade element are divided over their radial extent; wherein $$n_{max} \in [5;25]$$

$\alpha_s(n)$ describes a sickling angle at the profile section n of the blade element, i.e. an angle between a first limb motor shifted in parallel with the rotational axis and a second limb which is defined by the points of the front edge and rear edge of the strut in the sectional plane;

$D_H$ describes the external diameter of the motor mount (3);

$L_P$ describes the profile length of the strut (10), i.e. the distance between front and rear edge of the strut in the sectional plane;

$\beta_s(n)$ describes a correction factor of the sickling, wherein $$\beta_s(n) \in [-5;5]$$

$\beta R(n)$ describes a correction factor of the profile rotation, wherein $$\beta_R(n) \in [-30;30].$$

A "strut mean line" according to one or more embodiments, may also be referred to as profile centre line, camber line or curvature line, denotes the connecting line of the circle centre points which are inscribed into a profile, wherein the mean line runs straight from the projection circle centre point to the profile projection. A further alternative definition, which is also exclusively included according to the disclosure, defines the strut mean line to the effect that it is composed of the centre points between the upper side and lower side perpendicularly with respect to the X coordinate or profile chord. The course of the mean line also essentially determines the flow properties. Geometric characteristic numbers are the camber height and the point of maximum camber, wherein strut profiles with a straight or S-shaped mean line have a pressure point which changes only to a small extent with the blade angle.

A "blade element mean line" according to one or more embodiments, may also be referred to as profile centre line, camber line or curvature line, denotes the connecting line of the circle centre points which are inscribed into a profile, wherein the mean line runs straight from the projection circle centre point to the profile projection. A further alternative definition, which is also exclusively included according to the disclosure, defines the blade element mean line to the effect that it is composed of the centre points between the upper side and lower side perpendicularly with respect to the X coordinate or profile chord. The course of the mean line also essentially determines the flow properties. Important geometric characteristic numbers are the camber height and the point of maximum camber, wherein blade element profiles with a straight or S-shaped mean line have a pressure point which changes only to a small extent with the blade angle.

The functional relationships mentioned above are the result of extensive scientific studies and tests which for the first time describe a relationship between the strut mean line and the blade element mean line. For this purpose, the radial direction of extent of the blade elements or struts is divided into a number $n_{max}$ of equidistant profile sections, wherein the relationships described here have to be satisfied for at least one profile section, in particular for a plurality, in particular a predominant majority of $n_{max}$ profile sections.

The geometry of the blade element is included directly in the configuration of the strut by means of the blade element mean line which generates the sickling of the blade element.

The formula contains parameters of the blade element mean line in the form of the sickle angle $\alpha_s(n)$ at the profile section n of the blade element. Therefore, for the first time there is a functional relationship between the geometry of the blade element and the strut, which brings about a particularly advantageous sound pattern of the entire system. This is relevant, in particular, for electrically operated vehicles which have a significantly lower irradiation of noise, which is why a previously known cooling fan module would lead to an unpleasant perception of noise, since the covering noises of the classic main drive system, i.e. of the internal combustion engine, fall away.

According to a further embodiment, the defined functional relationships for the X and Y coordinates apply to all the sections $n \in [0; n_{max}]$.

This is advantageous, in particular, since in this way the defined functional relationships for X and Y coordinates which have proven to be advantageous in extensive test series apply to the entire radial extent of blade element and strut. Therefore, the advantageous effect of the reduction of noise can be improved further, since the passing of the blade element over the struts can take place in a "gentle" fashion, i.e. with reduced influencing of the flow vector of the main volume flow.

According to a further embodiment of the present disclosure, the struts have a semi-symmetrical profile.

A "profile" according to the present disclosure, may be the form of the cross section of the strut, wherein the sectional plane stands perpendicularly on a radial vector of the cooler fan module. This radial vector is, on the one hand, defined by the orientation of the rotational axis on which this vector stands perpendicularly, and by the point of the strut mean line in the sectional plane to be considered.

A profile with low camber, for example ranging from 1-3%, which does have a camber but no concave contours, is to be understood as a "semi-symmetrical profile" according to the present disclosure, and may also be referred to as a biconvex profile.

This is advantageous, in particular, since in this way the advantages described above for the cooling fan module according to the disclosure can be improved further in that not only the position of the strut is optimized in relation to the blade element but also the configuration of the strut, with the result that it is included as advantageously as possible in the main volume flow, in order thereby to avoid deflection and/or diversion of the air volume flow as well as possible.

According to a further embodiment of the present disclosure, the struts are arranged with respect to the rotational axis at a blade angle $\alpha$ in the range between 5 degrees and 45 degrees, for example, between 10 degrees and 25 degrees.

The "blade angle" according to one or more embodiments, which may also be referred to as "angle of inflow", is the angle between the direction of the inflowing fluid and the axial centre of the profile, that is to say the virtual straight connection between the profile projection and the rear edge of the profile.

This is advantageous, in particular, since in this way a further parameter is specified with which the strut can be configured in such a way that the deflection and/or diversion of the main volume flow is reduced further.

According to a further embodiment of the present disclosure, the struts emerge from the motor mount at an angle $\beta$ which has a value in the range from −30° to +30°; or −20° to +20°; or −10° to +10°.

This is advantageous, in particular, since extensive test studies and comparison studies have revealed that an excessively steep emergence of the strut from the motor mount causes the length to be increased considerably, resulting in a positive effect which is cancelled out again or, if appropriate, into reversed, by a "gentle" sliding of the edges over one another by means of the length of the strut.

According to a further embodiment of the present disclosure, the struts enter the fan shroud at a predefined angle φ which has a value in the range from −90° to +30°; or −75° and +15°; or −60° to 0°. This is advantageous, in particular, since in this way the struts can also be arranged as an engagement protection and can be adapted to the existing installation space when the system is configured.

According to a further embodiment of the present disclosure, a strengthening element is provided which is formed between the motor mount and one of the struts, for example, between the motor mount and a plurality of the struts, in particular between the motor mount and each strut.

This is advantageous, in particular, since in this way the rigidity of the cooling fan module overall and particularly of the struts can be improved. This reinforcement particularly between the motor mount and the strut is particularly advantageous since high shearing forces occur particularly at the transition between the motor mount and the strut as a result of the counter torque opposing the drive torque of the motor. Furthermore, the abovementioned advantages of an accumulation of material in the strut region immediately at the motor mount at least partially compensate the associated aerodynamic disadvantages, since the rotation speed and volume flow speed in this region are comparatively low compared to the external radius of the blade elements.

The strengthening element is embodied, in particular in the form of an accumulation of material which increases the radius at the transition from the strut to the motor mount, in order thereby to permit, in particular, an improved application of force.

According to one embodiment this is advantageous, in particular, since the strengthening element increases the strength of a strut, with the result that the strut is very dimensionally stable. The strengthening element is embodied, in particular, in one piece with the strut and/or the motor mount.

According to a further embodiment of the present disclosure, the fan shroud, the motor mount and the struts are formed as a single-piece plastic injection mould part.

This is advantageous, in particular, since in this way a cost-efficient near-to-end-shape original forming method can be used in order to make available the air shroud together with the motor mount and struts.

According to a further embodiment of the present disclosure, the struts have a reinforcement element.

According to a further embodiment, the reinforcement element comprises at least partially metal. For example, the reinforcement element is embodied in the form of a sheet steel. According to one embodiment this is advantageous, in particular, since in this way the dimensional stability and the strength of the struts can be increased.

According to a further embodiment of the present disclosure, the number of struts is different from the number of blade elements, in particular the cooling fan module has more struts than blade elements, in particular the cooling fan module has two struts more than blade elements, in particular the cooling fan module has eleven struts and nine blade elements. This refinement is advantageous, in particular, since in this way each blade element is in a different phase of the passing over of the strut, which brings about a more homogenous irradiation of noise with respect to the entire system.

The above refinements and developments can be combined with one another in any desired way in so far as anything else is not clearly apparent to the person skilled in the art from the description. Further possible refinements, developments and implementations of the disclosure also comprise combinations of features of the embodiments described above or below including those not explicitly mentioned. In particular, the person skilled in the art will also here add individual aspects as improvements or additions to the respective basic form of the present invention.

BRIEF DESCRIPTION OF THE DRAWINGS

The present disclosure is explained in more detail below on the basis of the exemplary embodiments specified in the schematic figures of the drawings.

DETAILED DESCRIPTION

Figure 1:
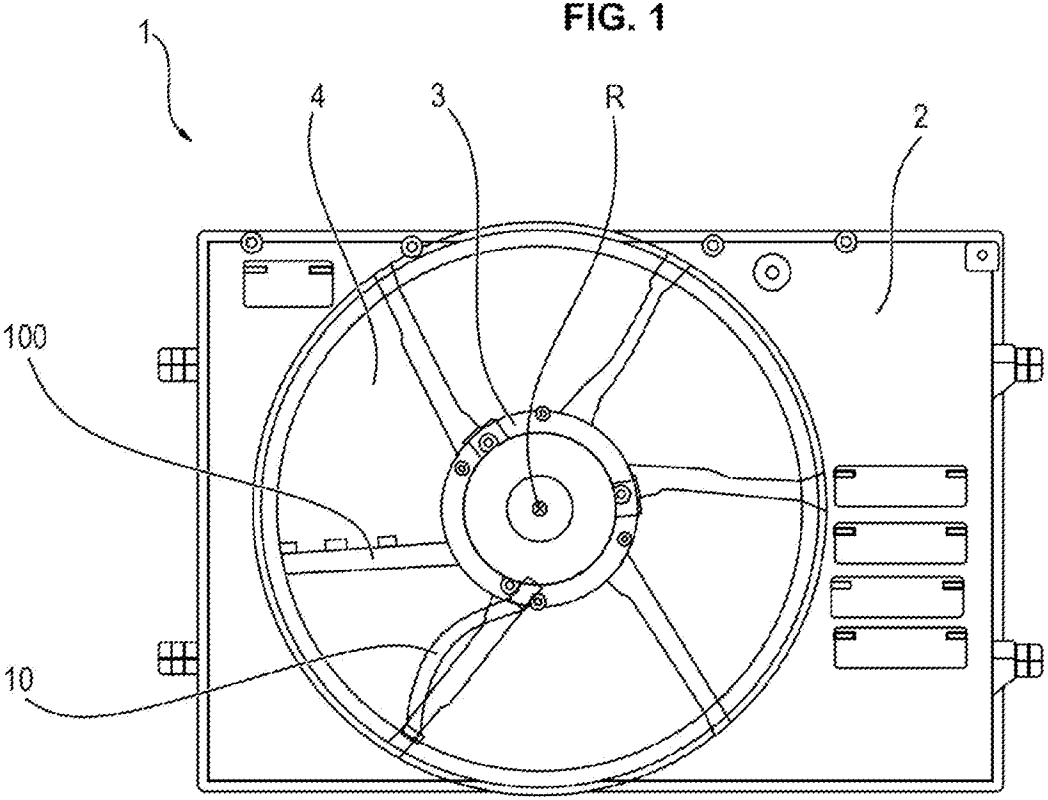
FIG. 1 shows a schematic plan view of a fan shroud from the prior art with an indicated strut according to one or more embodiments of the present disclosure.

A cooling fan module is classically composed of a fan shroud which has a fan propeller cutout. A motor mount, which is mechanically connected to the fan shroud by means of struts, is arranged in the fan propeller cutout. The struts can be arranged starting from the air volume flow on the downstream or upstream side of the air shroud. A motor, in particular an electric motor, is mounted in the motor mount. A fan propeller, which rotates, driven by the electric motor, in the fan propeller cutout, is arranged on an output shaft of the electric motor.

During the configuration and development of cooling fan modules, not only is the required air volume per time unit relevant, but also the available installation space, in particular its arrangement upstream or downstream of the cooler on the basis of the air volume flow and/or its dimensions and the generation of noise.

In particular with respect to the generation of noise it is significant whether the struts are arranged on the upstream or downstream side of the air shroud, which arises as a result of the basically different aerodynamic properties of these two variants: while the air on the upstream side (suction side) of the air shroud flows rather slowly and at least essentially in a laminar fashion, it is faster, denser and more eddied after the passage through the fan propeller cutout. For this reason, the requirements made on struts located at the front and struts located at the rear differ basically from one another, apart from the main requirement of mounting the motor mount: while struts which are located at the front can also perform feed functions and/or air directing functions, such struts are at least essentially irrelevant for struts located at the rear. Here, the important factor is rather that the struts are made as "invisible" as possible in aerodynamic terms, i.e. the struts have been configured in such a way that they influence the downstream air flow as little as possible.

DE 10 2012 112 211 A1 relates to a blower unit for a heat exchanger. The disclosed blower unit has straight spokes which are located at the rear and which connect an annular supporting element for holding an electric drive motor with a plate-like supporting structure.

The appended figures of the drawings are intended to convey further understanding of the embodiments of the disclosure. They illustrate embodiments and serve to explain principles and concepts of the invention in conjunction with the description. Other embodiments and many of the specified advantages are apparent from viewing the drawings. The elements of the drawings are not necessarily shown true to scale with respect to one another.

In the figures of the drawing, identical, functionally identical and identically acting elements, features and components are, unless stated otherwise, each provided with the same reference signs.

A "fan propeller cutout" according to one or more embodiments, may be a cutout portion of material within the fan shroud. According to one embodiment of the present disclosure, struts, which mechanically connect a motor mount, also arranged in the fan propeller cutout, to the fan shroud, extend in the fan propeller cutout. According to one embodiment of the present disclosure, the fan propeller cutout is bounded by a shroud ring.

A "motor mount" according to one or more embodiments, may be a device for mechanically securing the motor to the fan shroud, in particular for making available the torque which counteracts the fan propeller. According to one embodiment, the motor mount is an at least essentially annular structure in which the motor is mounted. This is advantageous, in particular, since in this way an advantageous flow of cooling air through the motor is not adversely affected.

"Flow direction" according to one or more embodiments, may refer to the main flow direction. In other words, flow which passes through the fan propeller cutout of the fan shroud parallel to the rotational axis of the fan propeller and is used to cool the cooler.

"Struts" according to one or more embodiments, may refer to bar-shaped or sickle-shaped structures which make available a mechanical connection between the motor mount and the fan shroud. According to one embodiment of the present disclosure, the struts can have a droplet-shaped cross section in order to achieve advantageous aerodynamic and/or acoustic effects.

A "motor" according to one or more embodiments, may refer to a machine which performs mechanical work in that it converts one form of energy, for example thermal/chemical or electrical energy, into kinetic energy, in particular a torque. This is advantageous, in particular, since in this way the fan shroud can, with the exception of the feeding in of energy, be operated at least essentially autonomously, that is to say without being supplied with kinetic energy from the outside, such as, for example, by a fan belt or toothed belt.

An "electric motor" according to one or more embodiments, may refer to an electromechanical converter (electric machine) which converts electrical power into mechanical power, in particular into a torque. The term electric motor according to the present disclosure comprises, but is not restricted to, direct current motors, alternating current motors and three-phase motors or electric motors with brushes and brushless or internal rotor motors and external rotor motors. This is advantageous, in particular, since electrical energy constitutes a form of energy which is easy to transmit compared to mechanical or chemical energy and with which the necessary torque for driving the fan propeller is made available.

A "fan propeller" according to one or more embodiments, may refer to a rotationally symmetrical component which connects a hub, in particular a hub pan, connecting the fan propeller to a motor, in particular via a shaft projecting therefrom, in such a way that the torque which is generated by the motor is transmitted at least essentially completely to the fan propeller.

A "blade element" according to one or more embodiments, may refer to an at least essentially flat body which is inclined with respect to a plane, on which the rotational axis stands perpendicularly, which body is arranged on the hub pan and which body is provided, in particular configured, to generate an air volume flow as soon as the fan propeller is made to move rotationally. The blade elements may be inclined with respect to the rotational axis here, in an angle range from −90° to +90°; or −75° to +75°; or −60° to +60°; or −45° to +45°; or −30° to +30°; or from −15° to +15°. Blade elements according to the present disclosure may be referred to as blades, shovel blades, or rotor blades.

"Forward-sickled" according to one or more embodiments, may refer to a tip of the blade element that leads with respect to the centre of the blade element, when viewed in the rotational direction.

"Rearward-sickled" according to one or more embodiments, may refer to a tip of the blade element that lags with respect to the centre of the blade element, when viewed in the rotational direction.

In other words, the geometry of the at feast one strut follows at least the geometry of the at least one blade element with respect to the extent in a plane perpendicular to the rotational axis. In particular, the geometry follows the strut mean line of the at least one strut, the blade element mean line of the at least one blade element With respect to the extent in a plane perpendicular to the rotational axis.

This may be advantageous, in particular, since in this way at least one of the negative effects of the struts, in particular those which are located at the rear, can be reduced, in particular with respect to the acoustics. For this it is necessary to know that struts are always disruptive during the development of fan shrouds. The volume flow which is generated by the fan propeller has, in particular viewed in the flow direction, an increased density just behind the fan propeller, and the individual air molecules move forward at a very high speed and with a swirl which is generated by the fan propeller. In this initial situation, the air molecules impact on the struts which "are in the way", as a result of which the air molecules are braked, and their direction is changed. In this context, undesired noise is produced, in particular when the blade, in particular the front edge thereof, moves over the strut. This generates Undesired noise, in particular what is referred to as "blocking" which is described in detail once more further below. Since the geometry of the strut follows at least essentially the geometry of the blade element with respect to the radial extent, it can be ensured that the front edge of the blade element impacts not simultaneously on its entire length on the strut but rather that there is always only one superimposition point which migrates in the radial direction. It is possible to consider here, for example, a commercially available pair of paper scissors in which the point of intersection of the two blades migrates along the direction of extent as soon as the scissors are closed.

FIG. 1 shows a schematic plan view of a fan shroud 2 of a cooling fan module 1 from the prior art with an indicated strut 10 according to one or more embodiments. The cooling fan module 1 has a fan shroud 2, a fan propeller cutout 4, which is formed in the fan shroud 2, a motor mount 3 which is mechanically connected to the fan shroud 2 by means of (previously known, straight) struts 100 which are located at the rear viewed in the flow direction, a motor, in particular electric motor 5, which is mounted at least partially in the motor mount 3, a fan propeller 6 which is arranged in the fan propeller cutout 4 and which is driven rotationally about a rotational axis R by the motor 5, wherein the fan propeller 6 has a plurality of blade elements 6*a*.

The motor mount 3 is connected to the fan shroud 2 via straight struts 100, as are sufficiently known from the prior art. A strut according to one or more embodiments, such as will be described in detail below, is already indicated in FIG. 1 by the reference symbol 10. In particular the geometric difference between previously known struts 100 and the struts 10 according to the disclosure is apparent in FIG. 1.

Figure 2:
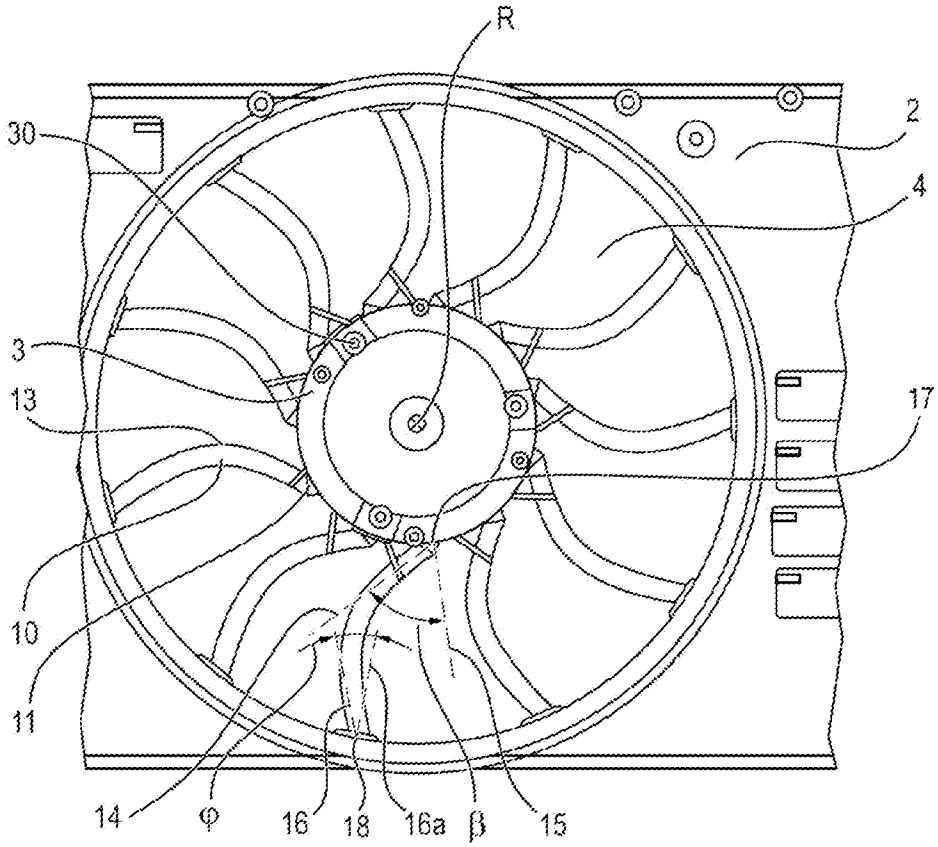
FIG. 2 shows a schematic plan view of a detail of a fan shroud according to one or more embodiments of the present disclosure.

FIG. 2 shows a schematic plan view of a detail of a fan shroud 2 according to an embodiment.

The fan shroud 2 is constructed from plastic, in particular in the form of a single-part plastic injection moulded part.

The struts 10 extend in a parabolic shape from the edge of the fan propeller cutout 4 to the motor mount 3 and hold the motor mount in position in the fan propeller cutout 4. The struts 10 each have a strengthening element 11 which strengthens the connection between the motor mount 3 and one of the struts 10 in each case. The strengthening element 11 is preferably constructed in one piece with the strut 10. The fan shroud 2, the struts 10 and the motor mount 3 are preferably a single-piece plastics injection mould part. Securing interfaces 30, to which a motor 5 can be secured, are provided on the motor mount 3. In addition, the angle β is illustrated which indicates the angle at which the strut 10 enters the motor mount 3. Limbs of the angle β are here, on the one hand, an extension vector 14 of the strut 10 at the exit point of the strut 10 from the motor mount 3 and, on the other hand, a radial vector 15 through the exit point of the strut 10 from the motor mount 3. According to one embodiment, β has a value in the range from −30° to +30°.

In addition, an angle φ is illustrated which indicates the angle at which the strut 10 enters the edge of the fan propeller cutout 4. Limbs of the angle φ are, on the one hand, an extension vector 16 of the strut 10 at the entry point of the strut 10 into the fan shroud 2 and, on the other hand, a radial vector 16*a* through the entry point of the strut 10 into the fan shroud 2. According to one embodiment, φ has a value in the range from −90° to +30°.

In the further course, a starting point 17 and an end point 18 will be discussed of individually in conjunction with the configuration of the strut 10 according to at least one embodiment. The starting point 17 is the exit point of the strut 10 from the motor mount 3 and the end point 18 is defined by the entry point of the strut 10 into the fan shroud 2.

Figure 3:
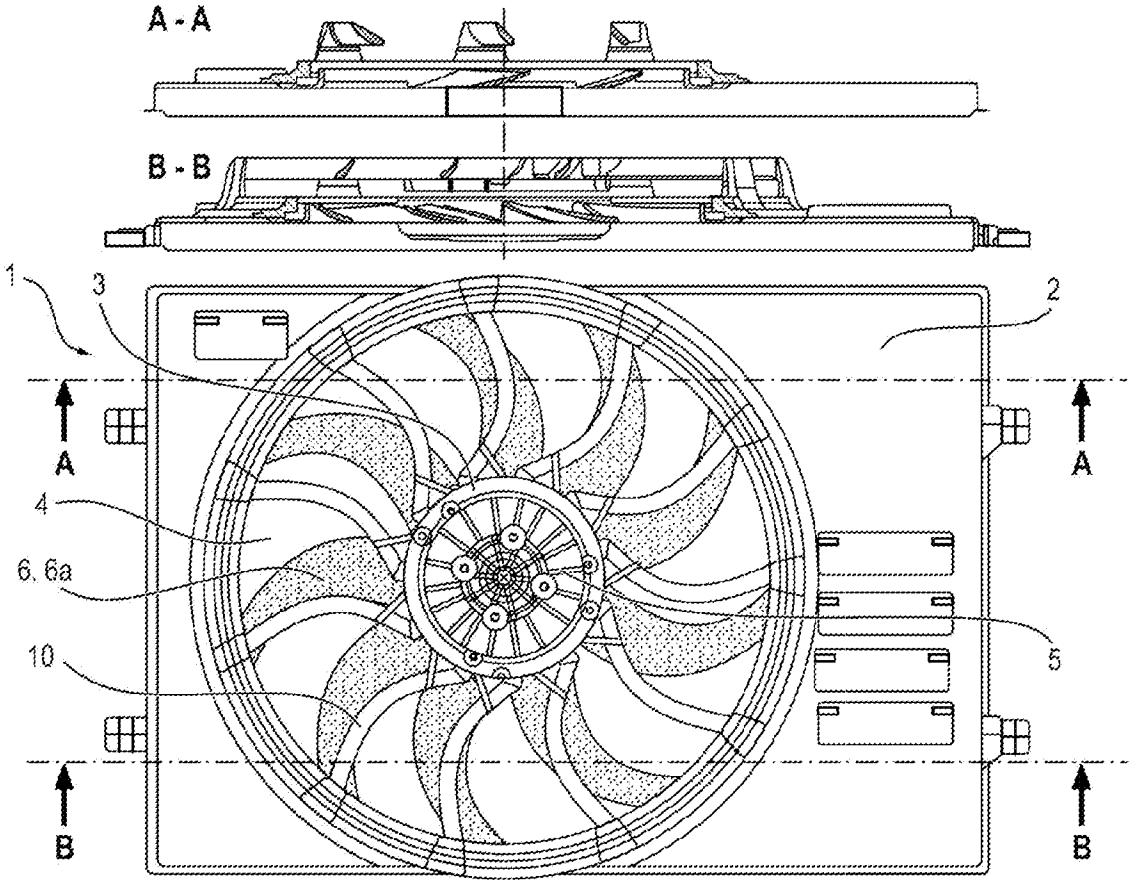
FIG. 3 shows a schematic plan view of a fan shroud according to a further embodiment of the present disclosure, together with two sectional illustrations.

FIG. 3 shows a schematic plan view of a fan shroud 2 according to a further embodiment of the present disclosure together with two sectional illustrations. The cooling fan module 1 which is illustrated in FIG. 3 is a cooling fan module with struts 10 located at the rear, i.e. viewed in the flow direction which is apparent from the sheet according to the illustration in FIG. 3, the air firstly is accelerated by the rotating fan propeller 6 and is compressed before it impacts on the struts 10, which constitutes the particular challenge when configuring such cooling fan modules and in particular the struts 10.

In this figure, the fan propeller 6 is shown for the first time with the plurality of blade elements 6*a*. This illustration shows how the blade elements 6*a* move behind the struts 10 pass them, from the point of view of the illustration in FIG. 3. According to the preferred embodiment in FIG. 3 the fan shroud 2 has eleven struts 10 and the fan propeller 6 has nine blade elements 6*a*. This structural property ensures that each blade element 6*a* is located in a different phase of the passing over of one of the struts 10 at each time during the rotation of the fan propeller. This gives rise to an advantageous, in particular more homogeneous, irradiation of noise of the entire system.

Figure 4:
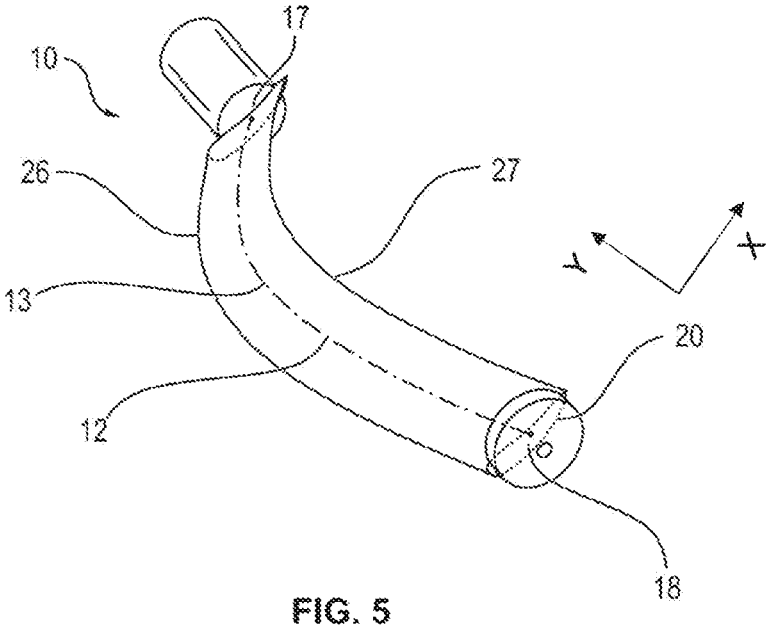
FIG. 4 shows a schematic perspective illustration of an individual strut according to one or more embodiments of the present disclosure.

FIG. 4 shows a schematic perspective illustration of an individual strut 10 according to at least one embodiment. The strut 10 connects the motor mount 3 to the fan shroud 2 and holds the motor mount 3 in position in the fan propeller cutout 4 of the fan shroud 2. The struts 10 make available the counter torque which is opposed to the torque which is generated by the motor with which torque the fan propeller 6 is driven. For this reason, strong forces are conducted via the struts 10, giving rise to increased rigidity requirements thereof. The strut 10 has a parabolic shape. A mean line 12 of the strut 10 runs from starting point 17 on the motor mount to the end point 18 on the fan shroud 2. The apex 13 of the strut is located at least essentially in the centre of the strut 10 in the axial direction.

The strut 10 also has an aerofoil profile. A region around a front edge 26 of a profile 20, in particular of a cross-sectional profile, is thicker than a region around a rear edge 27 of the profile 20. According to one particularly preferred embodiment, the aerofoil profile of the strut 10 is a semi-symmetrical profile.

Figure 5:
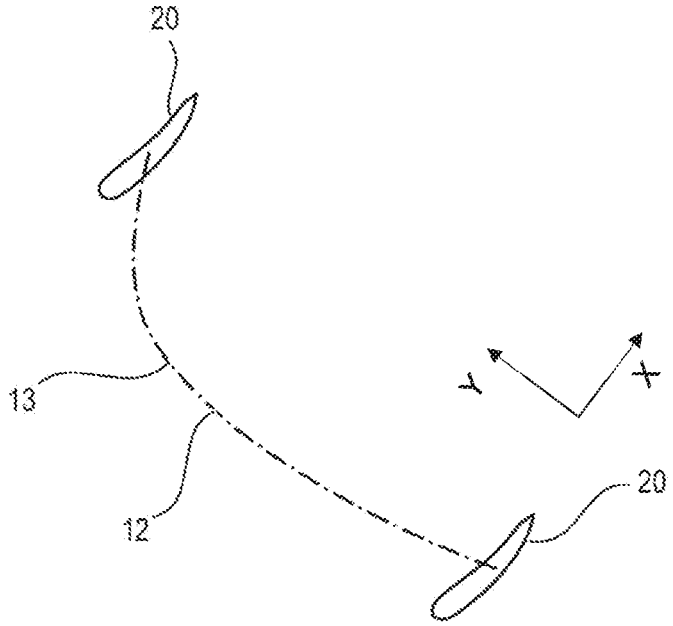
FIG. 5 shows a schematic perspective illustration of the profile and of the course of the strut mean line of an individual strut according to one or more embodiments of the present disclosure.

FIG. 5 shows a schematic perspective illustration of the profile and of the course of the strut mean line of an individual strut 10 according to an embodiment. The profile 20 of the strut 10 is embodied as an aerofoil profile according to this embodiment, wherein the mean line 12 of the strut 10 runs in a parabolic shape.

In particular, a blade element mean line of the blade element 6*a* and the strut mean line 12 in a profile section are related to one another by means of the following mathematical relationships:

$$X\text{-coordinate} = f(\alpha_S(n), \alpha_R, D_H, L_P, n, \beta_S(n), \beta_R(n)) = \sin\left(\alpha_{S(n)} \cdot \left(\frac{D_H}{2} + \frac{L_P \cdot n}{n_{max}}\right)\right) + \beta_S(n) + \cos\left(\alpha_S(n) + \frac{\alpha_R}{2}\right) \cdot \frac{L_P \cdot n}{n_{max}} \cdot \sqrt{2} \cdot \sqrt{1 - \cos(\alpha_R)} + \beta_R(n)$$

-continued $$Y\text{-coordinate} = f(\alpha_S(n), \alpha_R, D_H, L_P, n, \beta_S(n), \beta_R(n)) = \cos\left(\alpha_{S(n)} \cdot \left(\frac{D_H}{2} + \frac{L_P \cdot n}{n_{max}}\right)\right) + \beta_S(n) + \cos\left(\alpha_S(n) + \frac{\alpha_R}{2}\right) \cdot \frac{L_P \cdot n}{n_{max}} \cdot \sqrt{2} \cdot \sqrt{1 - \cos(\alpha_R)} + \beta_R(n)$$

where the following applies:

X coordinate describes the X coordinate of the point of intersection of the strut mean line with a sectional plane in an x-y coordinate system in the sectional plane Y coordinate describes the Y coordinate of the point of intersection of the strut mean line with a sectional plane in an x-y coordinate system in the sectional plane n describes a profile section which is currently under consideration $n_{max}$ describes into how many equidistant profile sections the strut and the blade element are divided over their radial extent; wherein $$n_{max} \in [5;25]$$

$\alpha_s(n)$ describes a sickling angle at the profile section n of the blade element, i.e. an angle between a first limb motor shifted in parallel with the rotational axis and a second limb which is defined by the points of the front edge and rear edge of the strut in the sectional plane;

$D_H$ describes the external diameter of the motor mount (3);

$L_P$ describes the profile length of the strut (10), i.e. the distance between front edge and rear edge of the strut in the sectional plane;

$\beta_s(n)$ describes a correction factor of the sickling, wherein $$\beta_s(n) \in [-5;5]; \text{ and}$$

$\beta_R(n)$ describes a correction factor of the profile rotation, wherein $$\beta_R(n) \in [-30;30],$$

wherein the defined functional relationships for the X and Y coordinates apply to all the sections $n \in [0; n_{max}]$ for $n_{max}=10$.

Figure 6:
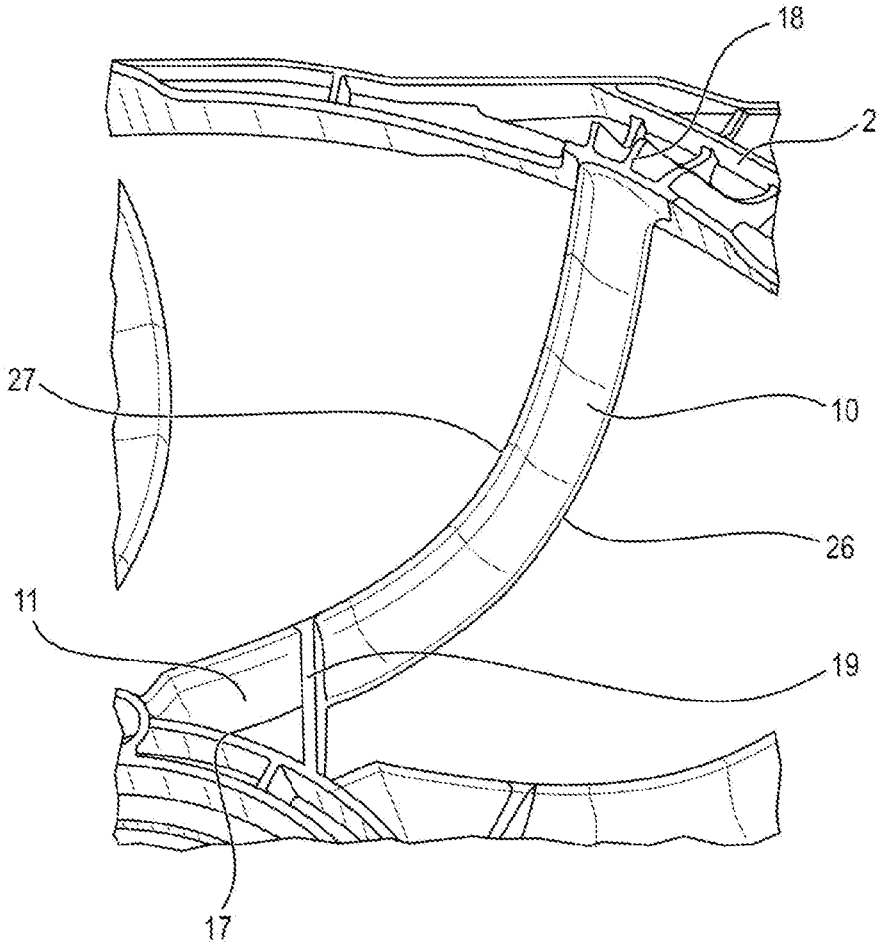
FIG. 6 shows a schematic three-dimensional view of a detail of an individual strut between the motor mount and the fan shroud according to one or embodiments of the present disclosure.

FIG. 6 shows a schematic three-dimensional view of a detail of an individual strut 10 between the motor mount 3 and the fan shroud 2 according to at least one embodiment. In this illustration, it is possible to see the strengthening element 11 between the strut 10 and the motor mount 3. The strengthening element 11 has a wall 19 which extends from the strut 10 at an angle. According to one embodiment, this angle corresponds in the amount to the angle β, so that the strut 10 and the wall 19 are arranged mirror-symmetrically with respect to a perpendicular of the circular motor mount 3. The strut 10 becomes more stable by virtue of the wall 19 and can as a result hold the motor 5 securely in position in the motor mount 3. According to the embodiment shown, the strengthening element 11 is formed in one piece with the strut 10 and the motor mount 3.

Figure 7:
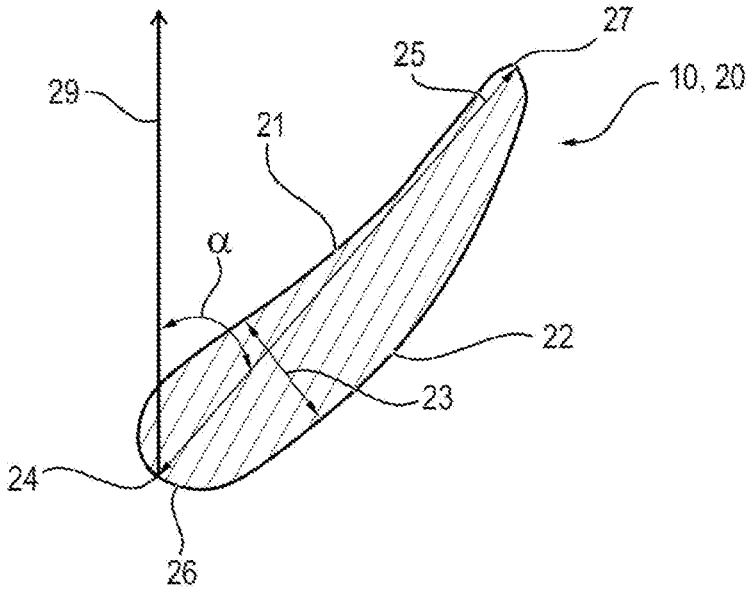
FIG. 7 shows a schematic sectional view of an individual strut according to one or more embodiments of the present disclosure.

FIG. 7 shows a schematic sectional view of an individual strut 10 according to at least one embodiment. The profile 20 of the strut 10 according to this embodiment is an aerofoil profile 20. A profile camber of the upper side 21 and a profile camber of the lower side 22 of the profile 20 run in the same direction. The upper side 21 is concavely curved while the lower side 22 has a convex curvature. In addition, the profile 20 has a profile thickness 23 and a profile depth 25. Moreover, the profile 20 has a projection radius 24 which specifies the radius of the projection of the profile. The region of the rear edge 27 of the profile 20 is narrower than the region of the front edge 26 of the profile 20. The blade angle α of the profile according to this embodiment is approximately 45° normal with respect to the blade surface. The air flows around the strut 10 in the direction of the arrow 29.

Figure 8:
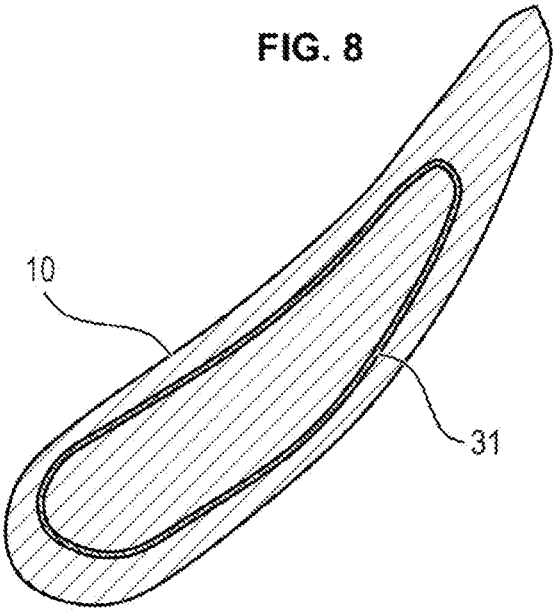
FIG. 8 shows a schematic sectional view of an individual strut with a reinforcement element according to a further embodiment of the present disclosure.

FIG. 8 shows a schematic sectional view of an individual strut 10 according to a further embodiment. In this embodiment of the strut 10, a reinforcement element 31 is provided in the strut 10. The reinforcement element 31 can have at least partially metal. For example, the reinforcement element 31 is formed from a sheet steel. Alternatively, the reinforcement element 31 can also be formed from aluminum. As a result of this embodiment, the strut 10 can be made particularly dimensionally stable.

Figure 9A:
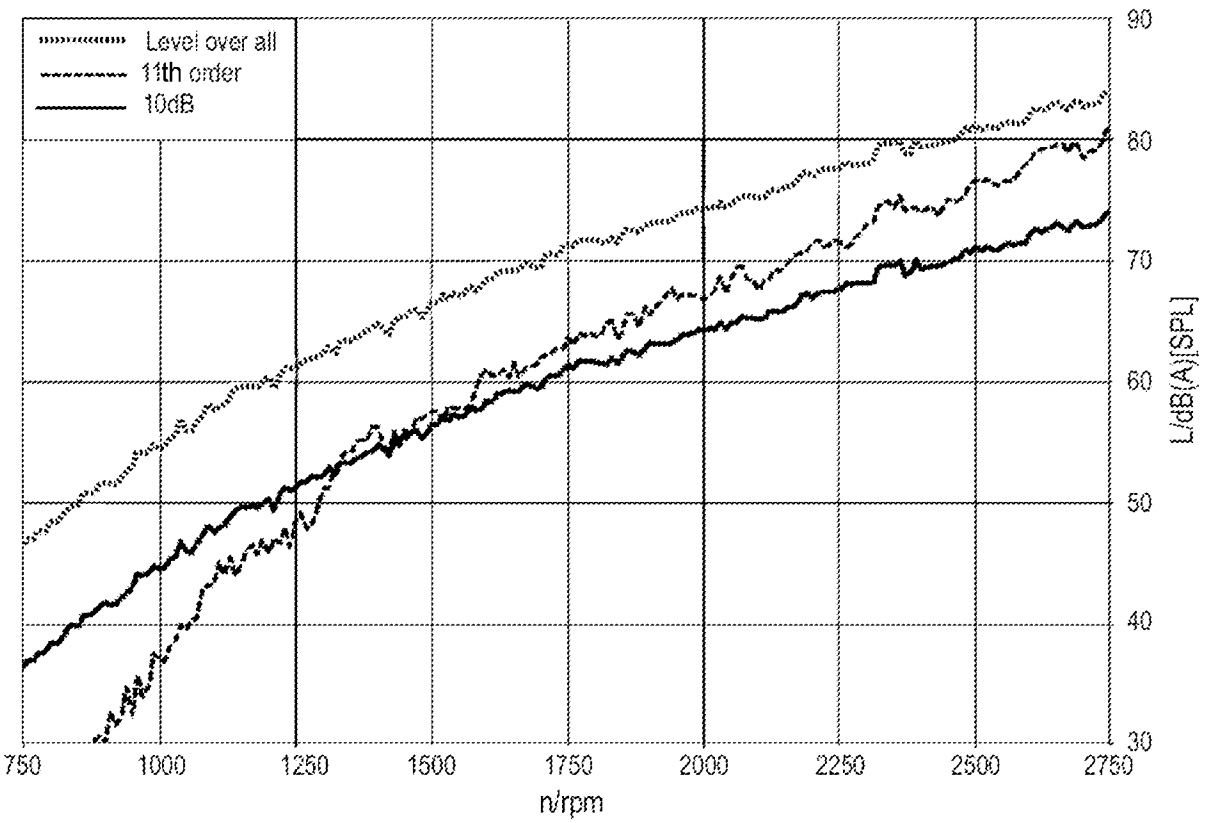
FIG. 9a Prior art
FIG. 9*a* shows a diagram with measured values of a cooling fan module according to the prior art.
Figure 9B:
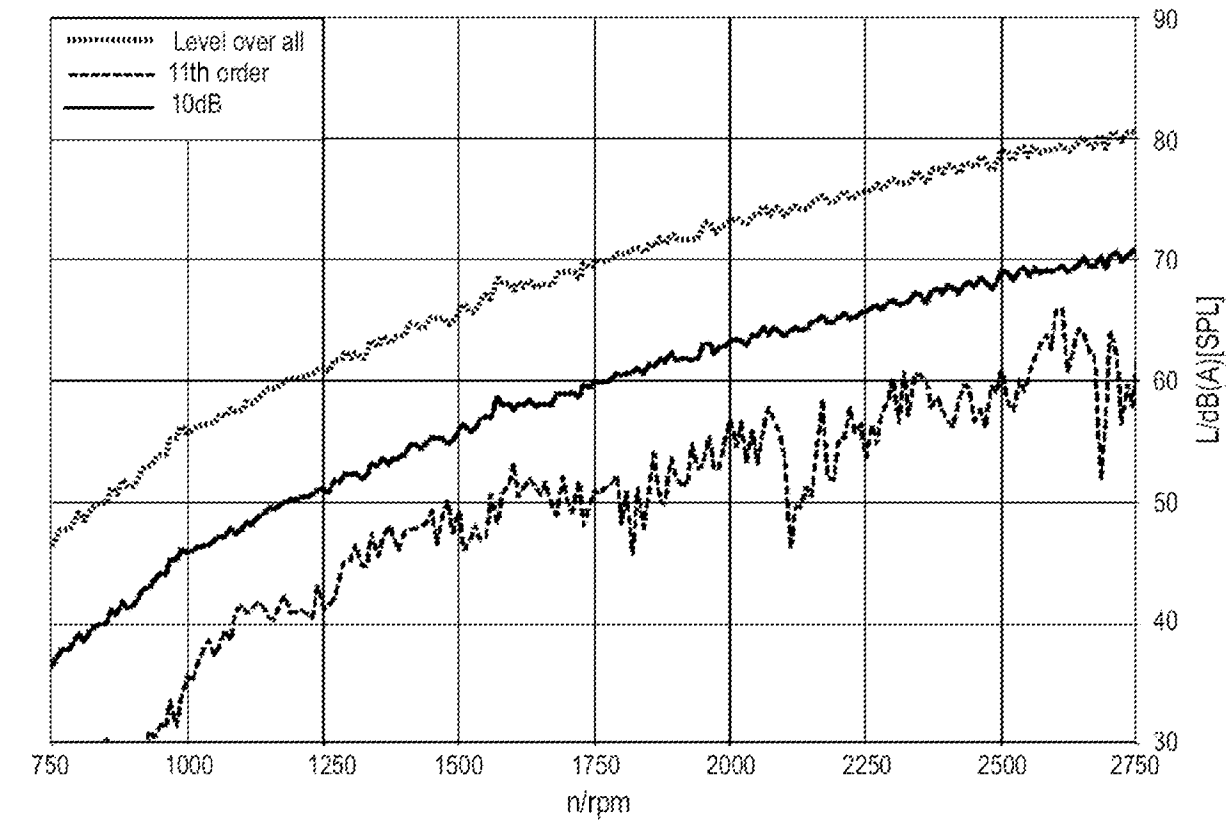
FIG. 9*b* shows a diagram with measured values of a cooling fan module according to one or more embodiments of the present disclosure.

FIG. 9*a* shows a diagram with measured values of a cooling fan module according to the prior art, and FIG. 9*b* shows a diagram with measured values of a cooling fan module according to at least one embodiment.

The diagrams represented in FIGS. 9*a* and 9*b* show the course of a sum level, and a fan propeller arrangement generated by the system in each case. The sum level specifies the overall irradiation of noise over all the frequencies. Both figures show the eleventh fan propeller arrangement which is dependent on the number of blades, their geometric arrangement and sickling.

Furthermore, the so-called 10 dB criterion which runs under the sum level at a distance of 10 dB is specified. The 10 dB criterion is relevant, in particular, for the evaluation of the sound pattern of a fan noise: the 10 dB criterion says that those frequency components which are below this 10 dB criterion are not perceived as disturbing. This can be imagined as in a large open office where individual voices are subsumed in a general murmur. On the other hand, noise components which infringe this 10 dB criterion are perceived as particularly disturbing. If all the frequency components run below the 10 dB criterion, the irradiation of noise is perceived as pleasant, "low" humming.

The represented FIGS. 9*a* and 9*b* have been measured at component level in the space having the heat exchanger which is low in semi-reflections. As a result of the configuration of the struts which occurred according to at least one embodiment, the eleventh fan blade arrangement is improved considerably in comparison with the prior art. The sum level is improved by up to 4 dB in comparison with the prior art and therefore now satisfies the 10 dB criterion for the first time.

Although the present invention has been described above completely on the basis of preferred exemplary embodiments, it is not restricted thereto but can instead be modified in a variety of ways.

The struts can be provided, for example, on the pressure side and/or on the vacuum side. In addition, the fan propeller can be adapted to the shape of the struts. For example, the front edge and/or the rear edge of the fan propeller has a curvature which corresponds to the curvature of the struts.

LIST OF REFERENCE SYMBOLS

1 Cooling fan module
2 Fan shroud
3 Motor mount
4 Fan propeller cutout
6 Fan propeller
6*a* Blade elements
10 Strut
11 Strengthening element

12 Mean line
13 Apex of the mean line
14 Extension vector of the strut at the exit point of the strut from the motor mount
15 Radial vector through the exit point of the strut from the motor mount
16 Extension vector of the strut at the entry point of the strut into the fan shroud
**16*a*** Radial vector through the entry point of the strut into the fan shroud
17 Starting point
18 End point
19 Strengthening wall
20 Profile
21 Profile camber of the upper side
22 Profile camber of the lower side
23 Profile thickness
24 Projection radius
25 Profile depth
26 Front edge
27 Rear edge
28 Perpendicular with respect to the motor mount
29 Direction of the air flow
30 Securing interface
31 Reinforcement element
100 Previously known, straight struts
1 Profile length
r2 Radius of upper side curvature
r3 Radius of lower side curvature
h Height
d1 Profile projection diameter
d2 Rear edge diameter
R Rotational axis
α Blade angle
β Angle
φ Angle

What is claimed is:

1. A cooling fan module having:

a fan shroud defining a fan propeller cutout;

a motor mount mechanically connected to the fan shroud by means of struts located at a rear side of the fan shroud, relative to a flow direction;

a motor mounted at least partially in the motor mount; and a fan propeller arranged in the fan propeller cutout and which is driven rotationally about a rotational axis by the motor, wherein the fan propeller has a plurality of blade elements, wherein at least all elements of a group which has at least one of the struts and at least one of the blade elements are forward-sickled or rearward-sickled and wherein a blade element mean line of the blade elements of the group and a strut mean line of the struts of the group in a profile section are related to one another by means of:

a $X$ coordinate =

$$f(\alpha_S(n), \alpha_R, D_H, L_P, n, \beta_S(n), \beta_R(n)) = \sin\left(\alpha_{S(n)} \cdot \left(\frac{D_H}{2} + \frac{L_P \cdot n}{n_{max}}\right)\right) + \beta_S(n) + \cos\left(\alpha_S(n) + \frac{\alpha_R}{2}\right) \cdot \frac{L_P \cdot n}{n_{max}} \cdot \sqrt{2} \cdot \sqrt{1 - \cos(\alpha_R)} + \beta_R(n)$$

a $Y$ coordinate = $f(\alpha_S(n), \alpha_R, D_H, L_P, n, \beta_S(n), \beta_R(n))$ =

$$\cos\left(\alpha_{S(n)} \cdot \left(\frac{D_H}{2} + \frac{L_P \cdot n}{n_{max}}\right)\right) + \beta_S(n) +$$

-continued $$\cos\left(\alpha_S(n) + \frac{\alpha_R}{2}\right) \cdot \frac{L_P \cdot n}{n_{max}} \cdot \sqrt{2} \cdot \sqrt{1 - \cos(\alpha_R)} + \beta_R(n)$$

where the following applies:

the X coordinate is a point of intersection of the strut mean line with a sectional plane in an x-y coordinate system in the sectional plane;

the Y coordinate is a point of intersection of the strut mean line with the sectional plane in an x-y coordinate system in the sectional plane;

n describes a profile section which is currently under consideration;

$n_{max}$ describes into how many equidistant profile sections the strut and the blade elements are divided over their radial extent; wherein $$n_{max} \in [5;25]$$

$\alpha_s(n)$ describes a sickling angle at the profile section n of the blade element, and between a first limb motor shifted in parallel with the rotational axis and a second limb which is defined by the points of a front edge and a rear edge of the strut in the sectional plane;

$D_H$ describes an external diameter of the motor mount;

$L_P$ describes a profile length of the strut, measured between a front edge and a rear edge of the strut in the sectional plane;

$\beta_s(n)$ describes a correction factor of the sickling, wherein $$\beta_s(n) \in [-5;5]; \text{ and}$$

$\beta_R(n)$ describes a correction factor of a profile rotation, wherein $$\beta_R(n) \in [-30;30].$$

2. The cooling fan module of claim 1, wherein the group comprises a plurality of the struts and/or a plurality of the blade elements.

3. The cooling fan module of claim 1, wherein defined functional relationships for the X and Y coordinates apply to all of the profile sections $n \in [0; n_{max}]$.

4. The cooling fan module of claim 1, wherein the struts have a semi-symmetrical aerofoil profile.

5. The cooling fan module of claim 4, wherein a blade angle α ranges between 10 degrees and 25 degrees.

6. The cooling fan module of claim 1, wherein the struts define a blade angle α wherein the blade angle α with respect to the rotational axis, and wherein the blade angle α ranges between 5 degrees and 45 degrees.

7. The cooling fan module of claim 1, wherein the struts emerge from the motor mount at an angle β, wherein the angle β ranges between −30° and +30°.

8. The cooling fan module of claim 1, wherein the struts enter the fan shroud at a predefined angle φ, wherein the predefined angle φ ranges between −90° and +30°.

9. The cooling fan module of claim 1, further comprising a strengthening element provided between the motor mount and one of the struts.

10. The cooling fan module of claim 9, wherein the fan shroud, the motor mount, and the struts are formed as a single-piece of plastic by injection molding.

11. The cooling fan module of claim 1, wherein at least one of the struts has a reinforcement element.

12. A cooling fan module having:

a fan shroud defining a cutout;

a motor mount;

a motor defining a rotational axis and mounted to the motor mount;

a plurality of struts extending between the fan shroud and the motor mount;

a reinforcement element at least partially surrounded by the strut wherein the reinforcement element is hollow; and a fan propeller disposed in the cutout, configured to rotate about the rotational axis, including a plurality of blades, wherein in a first cross-sectional plane and a second cross-sectional plane, each parallel to the rotational axis, wherein, one of the blades defines a blade element mean line that defines a profile of the blade that extends between the first cross-sectional plane and the second cross-sectional plane, one of the struts defines a strut mean line, that defines a profile of the strut that extends between the first cross-sectional plane and the second cross-sectional plane, and a sickling of the blade is based on the strut mean line of the strut.

13. The cooling fan module of claim 12, wherein the motor mount defines an external diameter, and wherein the profile of the blade element is at least partially based on the external diameter of the motor mount.

14. The cooling fan module of claim 13, wherein the struts emerge from the motor mount at an angle β, measured from a radial vector defined by the motor mount, that ranges between −30° and +30°.

15. The cooling fan module according to claim 13, wherein the struts enter the fan shroud at a predefined angle φ, measured from a radial vector defined by the motor mount, that ranges between −90° and +30°.

16. The cooling fan module according to claim 13, further comprising a strengthening element wherein the strengthening element includes a wall that extends from the motor mount and terminates at one of the struts.

17. The cooling fan module of claim 12, wherein a distance between the first cross-sectional plane of the strut and the second cross-sectional plane of the strut defines a profile length of the strut, and wherein the profile of the blade element is at least partially based on the profile length of the strut.

18. A cooling fan module comprising:

a fan shroud defining a cutout;

a motor mount disposed in the cutout configured to support a motor;

a strut extending between the fan shroud and the motor mount; and a reinforcement element at least partially surrounded by the strut wherein the reinforcement element is hollow.

19. The cooling fan module of claim 18, wherein the reinforcement element is fixed to the strut by injection molding.

* * * * *